United States Patent [19]

Jordan

[11] 4,031,837

[45] June 28, 1977

[54] METHOD OF REFORMING A CAN END

[75] Inventor: Charles L. Jordan, Upper Burrell Township, Westmoreland County, Pa.

[73] Assignee: Aluminum Company of America, Pittsburgh, Pa.

[22] Filed: May 21, 1976

[21] Appl. No.: 688,583

[52] U.S. Cl. ..... 113/121 C

[51] Int. Cl.² ..... B21D 51/44

[58] Field of Search ..... 113/121 R, 121 C, 1 F, 113/121 AB, 15 A; 220/265, 266, 270; 72/348, 349, 356

[56] References Cited

UNITED STATES PATENTS

| | | | |
|---|---|---|---|
| 1,385,290 | 7/1921 | Welling | 113/121 R |
| 1,838,302 | 12/1931 | Evans | 113/121 C |
| 2,017,460 | 10/1935 | Hothersall | 113/121 C |
| 3,417,898 | 12/1968 | Bozek et al. | 220/66 |
| 3,537,291 | 11/1970 | Hawkins | 72/336 |

*Primary Examiner*—Michael J. Keenan

*Attorney, Agent, or Firm*—David W. Brownlee; William J. O'Rourke, Jr.

[57] ABSTRACT

A method is disclosed for reforming a metallic can end to increase the pressure holding capabilities of the container to which the can end is seamed comprising the steps of increasing the depth of an annular groove with respect to a substantially planar center wall and reducing the radius of curvature of a curved portion at the bottom of the annular groove between an inner wall on the inside of the annular groove and an integral chuckwall on the outside of the annular groove.

10 Claims, 8 Drawing Figures

METHOD OF REFORMING A CAN END

BACKGROUND OF THE INVENTION

1. Field of the Invention

The present invention relates to a method of reforming a metal can end, and more particularly, to a method of reforming a circular can end having an annular groove around a center wall portion and a flange around the periphery of the can end which is typically seamed to a cylindrical can body containing beer or other carbonated beverage.

2. Description of the Prior Art

The prior art discloses numerous examples of metallic end closures for cans. The majority of such can ends have an end wall with an opening panel therein, an annular groove around the top end wall and a flange around the periphery of the can end.

The required gauge of the sheet metal end closure to be seamed onto a cylindrical beverage can body is determined by the yield and tensile strength required to resist buckling of the end closure at internal pressures of approximately 90 pounds per square inch. Typical end closures are able to tolerate internal pressures of approximately 85 to 90 pounds per square inch without significant distortion or buckling. Buckling is a phenomenon that primarily occurs when at least a portion of a chuckwall of a can end seamed onto a cylindrical can body is pulled upwardly and radially inwardly away from its connection to the can body in response to high internal pressures. Results of buckling may be exhibited as minor outwardly deformations in the generally planar can end and may range to a complete blow-out of the can end from the can body. The problems associated with buckling of a can end include premature opening of the can end or the easy open panel therein and vertical can stacking difficulties.

Prior art disclosures pertaining to reinforcement of can ends include U.S. Pat. No. 3,774,801 which relates to shaping or flexing the inner wall of a U-shaped reinforcing groove of a can end with radially separated concave areas of curvature to improve the can end's resistance to internal pressure. Of interest, also, is U.S. Pat. No. 3,843,014 which discloses a cover for a container with a peripheral neck having a radius of curvature within the range of 0.5 to 1.2 mm (approximately .020 to .047 inches) and a substantially rectilinear portion integral with and connecting the neck with a central portion. Such formation allegedly permits reduction in thickness of the can end on the order of 10 to 20 percent with internal pressure resistance capability equal to that of the conventional can end.

Another prior art disclosure of interest is U.S. Pat. No. 3,912,113 which pertains to an end panel for a container including a well having at its base a partial score and an opening flap. This patent discloses the provision of a coined area in the panel encompassing the well in order to inhibit distortion or blow-out of the opening flap in the end panel due to internal over pressurization.

Attempts at drawing, in a single step, a metal blank into a can end having a sharper than usual radius of curvature at the bottom of the annular groove have resulted in shearing or otherwise damaging of the sheet metal at or near the annular groove. The sheet metal blank is too thin to be drawn to such sharp radii of curvature in a single operation. Additional reforming steps to form reinforced can ends require an added investment in equipment, such as a press.

Accordingly, a new and improved method of producing a pressure resistant can end by reforming a conventional metallic can end is desired to increase the pressure holding capabilities of the container to which the can end is seamed.

SUMMARY OF THE INVENTION

This invention may be summarized as providing a new and improved method for providing a pressure resistant can end by reforming a metallic can end to increase the depth of an annular groove with respect to a substantially planar center wall and reduce the radius of curvature of a curved portion at the bottom of the annular groove between an inner wall on the inside of the annular groove and an integral chuckwall on the outside of the annular groove.

Among the advantages of the subject invention is the provision of a method for reforming a metallic can end of reduced gauge or thickness which is able to resist buckling at high internal can pressures.

Another advantage of the present invention is the provision of a method of reforming a metallic can end which is better able to resist buckling at high internal can pressures to thereby permit use of alloys having lower tensile strength.

Another object of the invention is to provide a relatively simple method of reforming a can end such that it will better resist over pressurization.

A further object of this invention is the provision of a method for reforming a metallic can end including the steps of changing the radii of curvature of certain curved portions of the can end with little or no resultant thinning, fracturing or ironing of the sheet metal.

Another advantage of the present invention is the provision of a method of reforming any conventional can end in a conversion press without the necessity of initially forming a can end. Therefore, this method may be employed by many secondary suppliers or producers without requiring an investment in the initial forming equipment.

It follows that another advantage of the present invention is to provide a relatively simple method of forming a reinforced thin gauge can end.

The foregoing and other objects and advantages of this invention will be more thoroughly comprehended and appreciated with reference to the following description and the drawings appended hereto.

DESCRIPTION OF THE PREFERRED EMBODIMENTS

Figure 1:
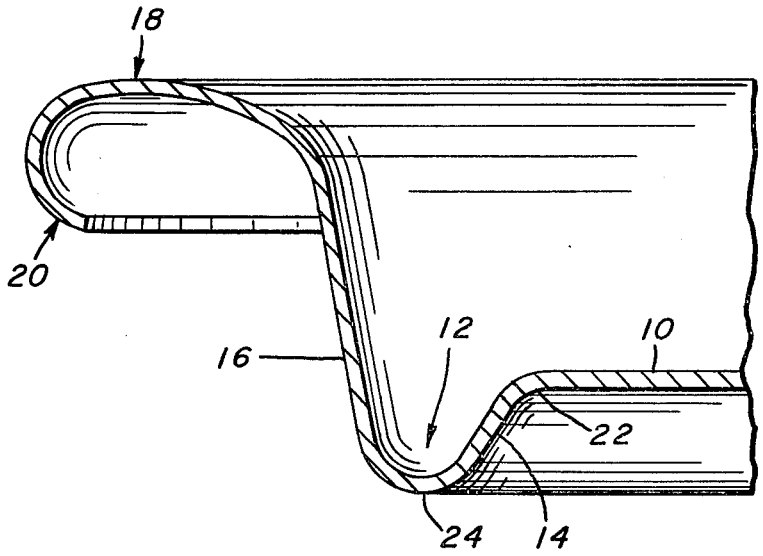
FIG. 1 is an enlarged fragmentary cross-sectional view of a can end before it has been reformed according to the present invention.

Referring particularly to the drawings, FIG. 1 illustrates a typical sheet metal can end which includes a substantially planar center wall 10, an annular groove 12 bounded on the inside circumference by an integral inner wall 14 and bounded on the outside circumference by an integral chuckwall 16, and a peripheral flange 18 extending radially outwardly from the top of the chuckwall 16 with a curled edge 20 on such flange 18. Between the center wall 10 and the inner wall 14 is a first curved portion 22, and at the bottom of the annular groove 12 between the inner wall 14 and the chuckwall 16 is a second curved portion 24.

Figure 2:
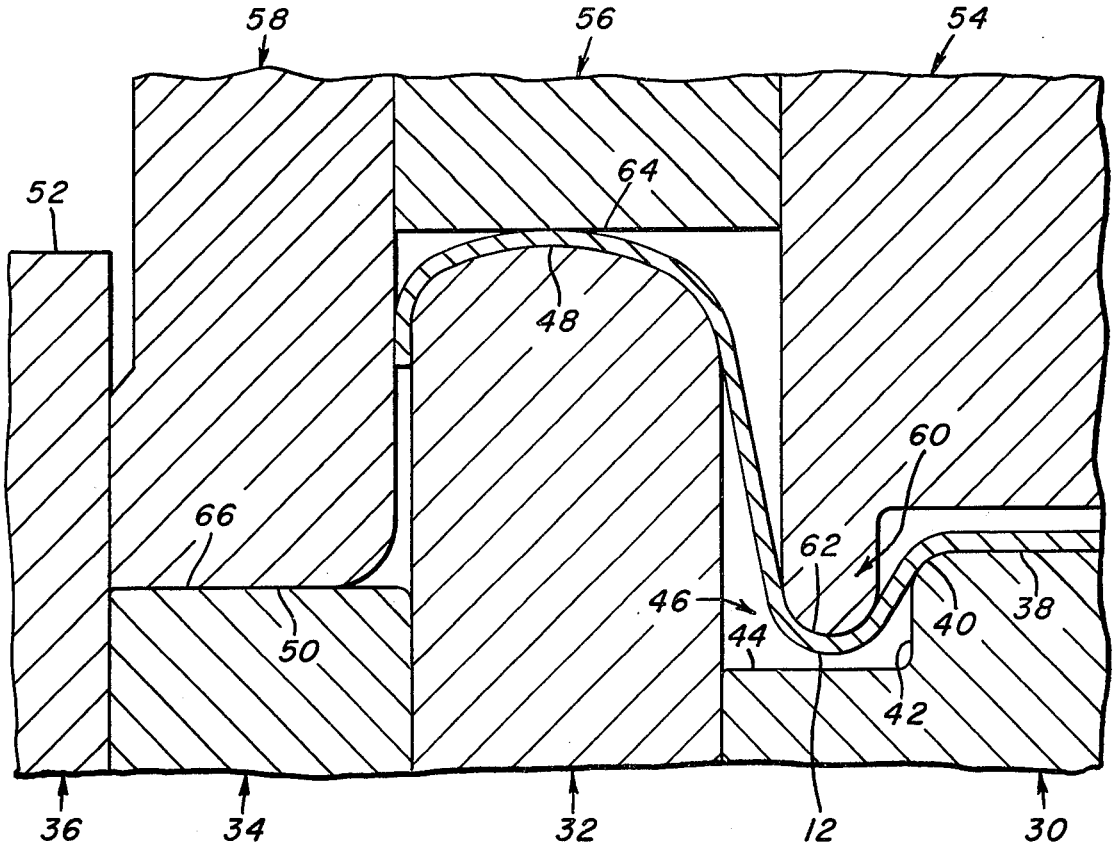
FIG. 2 is an enlarged fragmentary cross-sectional view through dies for cutting a blank from a sheet of metal and forming the blank into the can end of FIG. 1.

FIG. 2 illustrates exemplary tools which may be employed to cut a blank from a sheet of metal and form the blank into a conventional can end. The lower dies include a centrally located die core insert 30, an annular draw ring 32 around the die core insert 30, a spring loaded pad 34 around the draw ring 32 and an annular shearing ring 36 around the pad 34. The upper dies include a circular punch core insert 54, a knock-out tool 56 around the insert 54 and a punch cut tool 58 around the knock-out tool.

In the operation of the dies to the position illustrated in FIG. 2, the peripheral edge portion of the sheet metal inserted therebetween has been sheared through the conjoint action of a top surface 52 of the stationary shearing ring 36 and a bottom surface 66 of the downwardly traveling punch cut tool 58. After such peripheral edge is sheared, it is drawn from between the tools 58 and 34 inwardly and upwardly between the outside surface of the draw ring 32 and the inside surface of the punch cut tool 58. As the upper dies are further moved against the lower dies, a bottom surface 62 of a downwardly projecting ridge 60 on the punch core insert 54 proceeds downwardly into a recess 46 provided around the periphery of the die core insert 30 and thereby draws the annular groove 12 in the blank positioned therebetween. A rounded corner 40 on the die core insert 30, a curvilinear bottom surface 62 on the ridge 60 and a curvilinear top surface 48 of the draw ring 32 permit the metal from the blank to be drawn into the annular groove 12 without tearing or otherwise damaging the blank. Upon completion of forming the can end, the upper dies are withdrawn upwardly and the knock-out tool 56 pushes the can end off the upper dies.

The next step in forming the can end is the curling operation, not shown, performed on the peripheral flange 18 of the drawn can end shown in FIG. 2. In the well known curling operation, the flange 18 of the can end is rotated around a conventional curling roll in a known manner to provide a rounded bead-like formation 20 in the downturned peripheral flange 18 of the can end.

Figure 3:
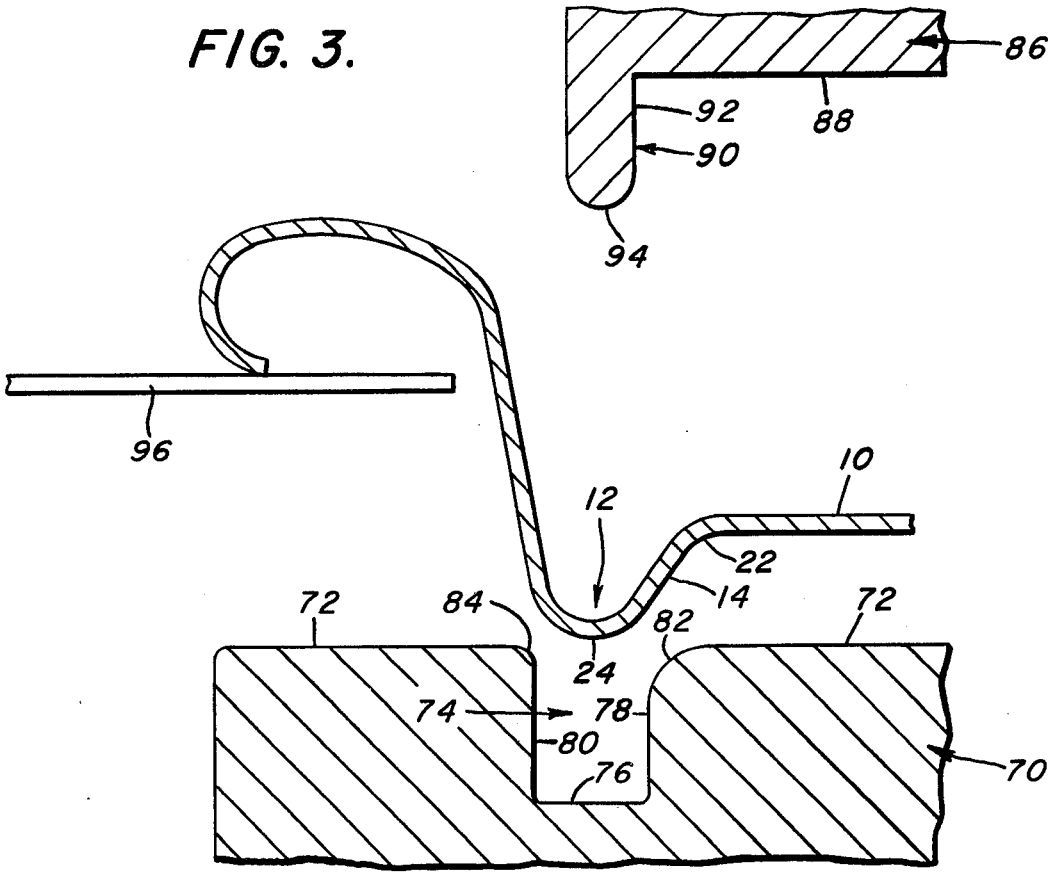
FIG. 3 is an enlarged fragmentary cross-sectional view through dies for reforming the can end shown in FIG. 1 into the reinforced can end in accordance with the present invention.
Figure 4:
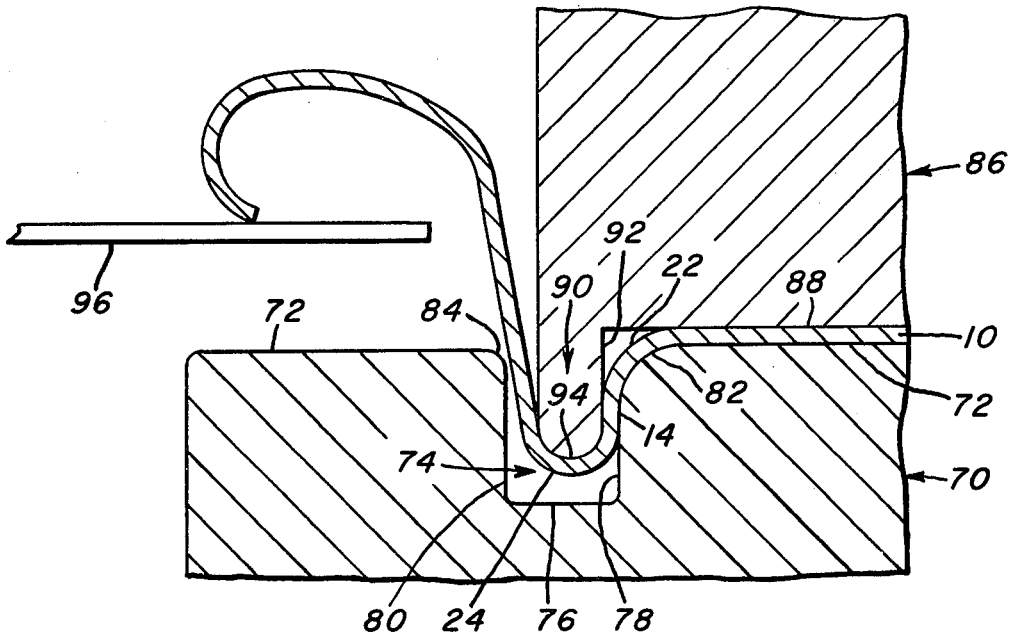
FIG. 4 is an enlarged fragmentary cross-sectional view similar to FIG. 3 showing completion of the reinforced can end.

FIGS. 3 and 4 illustrate opposing dies which may be employed to reform the drawn metallic can end in accordance with the present invention. The bottom die 70 has a generally planar top surface 72 interrupted by an annular slot 74 having an upwardly facing bottom surface 76, an outwardly facing inside surface 78 and an inwardly facing outside surface 80. The inside surface 78 and the outside surface 80 are substantially perpendicular to the top surface 72 of the die 70. There is a first rounded corner 82 provided at the junction of the inside surface 78 and the top surface 72. The radius of curvature of the first rounded corner 82 of the die 70 is preferably greater than the radius of curvature of the rounded corner 40 of the insert 30 of the initial forming tools shown in FIG. 2. For example, in reforming a 5182 aluminum alloy can end in coated, extra hard H-19 temper having a 0.0127 inch gauge, the radius of curvature of the rounded corner 40 of the insert 30 of the initial forming tools is approximately 0.030 inch, and the radius of curvature of the rounded corner 82 of the die 70 of the reforming tools is approximately 0.050 inch. In another can end formed in accordance with the method of the present invention, the radius of curvature of rounded corner 82 may be less than the radius of curvature of rounded corner 40. An exemplary reduced radius of curvature of rounded corner 82 is 0.020 inch.

The top punch 86 has a substantially planar bottom surface 88 and a downwardly projecting annular ridge 90 having an inwardly facing surface 92 and a downwardly facing curvilinear bottom surface 94. The surface 92 is substantially parallel to the inside surface 78 of the slot 74 in the bottom die 70. Also, the radius of curvature of the curvilinear bottom surface 94 of the ridge 90 is less than the radius of curvature of the curvilinear bottom surface 62 of the ridge 60 of the initial forming tools shown in FIG. 2. For example, in reforming an aluminum can end of the alloy, gauge and temper described in the preceeding paragraph, the radius of curvature of the curvilinear bottom surface 62 of the ridge 60 of the initial forming tools is approximately 0.030 inch, and the radius of curvature of the curvilinear bottom surface 94 of the ridge 90 of the reforming tools is approximately 0.020 inch. In a preferred embodiment of the tools, as illustrated in FIGS. 3 and 4, the outwardly facing inside surface 78 of the slot 74 in the bottom die 70 mates with the inwardly facing surface 92 on the ridge 90 of the top punch 86 except for a tight sheet metal clearance provided therebetween. Such clearance is preferably 0.001 inch greater than the gauge of the metal being reformed.

In the practice of the invention, a can end such as that illustrated in FIG. 1 may be seated in an aperture in a metal conveyor belt 96 and transported to a conversion press where the can end may be relatively easily reformed without requiring an additional press or other equipment. The annular rim formed by the groove 12 in the can end projects downwardly such that the curved portion 24 at the bottom of the groove 12 is partially seated in the slot 74 in the bottom die core insert 70. After the can end is so positioned between the dies, as illustrated in FIG. 3, the top punch 86 is moved downward toward the stationary die 70 to engage the sheet metal in the groove 12 of the can end and draw the metal downwardly until the top surface 72 of the die 70 engages the center wall 10 of the can end. The rounded corner 82 of the die 70 and the curvilinear bottom surface 94 of the ridge 90 permit the metal of the formed can end to be reformed, or redrawn, into a deeper annular groove 12 with respect to the center wall 10 of the can end. Also, the sheet metal in the can end conforms to the shape of the dies at rounded corner 82 of the die 70 and the curvilinear bottom surface 94 of the ridge 90. The reformed can end is, therefore, characterized by an annular groove which is deeper than that of the initially formed can end and a reduced radius of curvature at curved portion 24.

In preferred tools for practice of the present invention, the inwardly facing surface 92 of the ridge 90 and the inside surface 78 of the die 70 are not only parallel to each other, but also perpendicular to the top surface 72 of the insert 70. Such tools assure that at least a portion of the inner wall 14 between the first and second curved portions 22 and 24 respectively, will be formed to be perpendicular to the plane of the center wall 10 of the reformed can end.

The above-described secondary reforming operation is performed without substantially fracturing or thinning the metal in the can end. It is understood by those skilled in the art that altering the radii of curvature of the reformed can end could not be obtained in a single forming operation without damaging the sheet metal can end.

Figure 5:
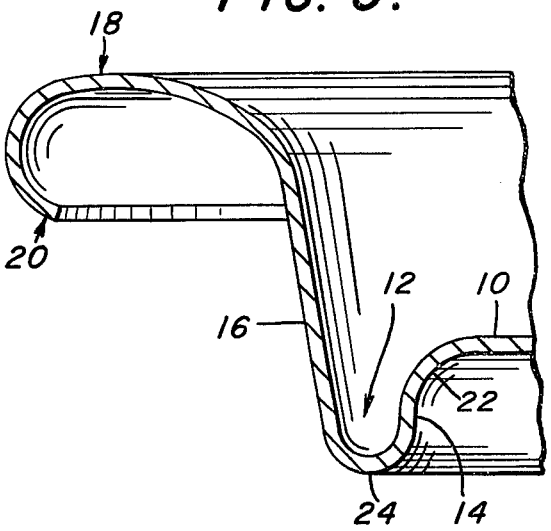
FIG. 5 is an enlarged fragmentary cross-sectional view of a reformed can end.

FIG. 5 illustrates the sheet metal can end shown in FIG. 1 after it has been reformed according to a preferred mode of the present invention. In comparison to the can end as shown in FIG. 1, the depth of the annular groove 12, in the can end as shown in FIG. 5 is increased preferably from 0.066 inch to 0.090 inch, the radius of curvature of the first curved portion 22 is increased preferably from 0.030 inch to 0.050 inch, the radius of curvature of the second curved portion 24 has been reduced preferably from 0.030 inch to 0.020 inch, and the inner wall 14 between the first and second curved portions, 22 and 24, has been reoriented such that at least a portion of the inner wall 14 is perpendicular to the plane of the center wall 10.

In accordance with this invention the diameter of the can end, as measured at the outermost portion of the peripheral flange 18, is not altered during the reformation operation. Preferably, the slope of the chuckwall 16 is not changed in order that the reformed can end may be handled without modifying any of the existing handling or seaming equipment. Also, while it is understood that the depth of the annular groove 12 with respect to the center wall 10 is preferably increased during reformation, the depth of the annular groove 12 with respect to the peripheral flange 18 may be decreased or remain unchanged after the reformation operation.

Figure 6:
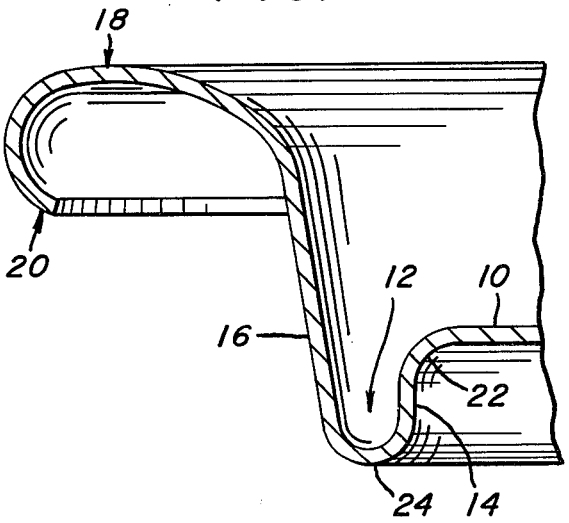
FIG. 6 is an enlarged fragmentary cross-sectional view of an alternative embodiment of a reformed can end of the present invention.

In an alternative mode of the present invention, shown in FIG. 6, a can end is reformed such that the depth of the annular groove 12 is increased and the radius of curvature of the second curved portion 24 at the base of the annular groove 12 is reduced as described above. In this embodiment, however, the radius of curvature of the first curved portion 22 of the can end is reduced, preferably from 0.030 to 0.020 inch. When the radius of curvature of the first curved portion 22 is reduced, as shown in FIG. 6, rather than increased as shown in FIG. 5, a larger portion of the inner wall 14 may be perpendicular to the center wall 10.

Figure 7:
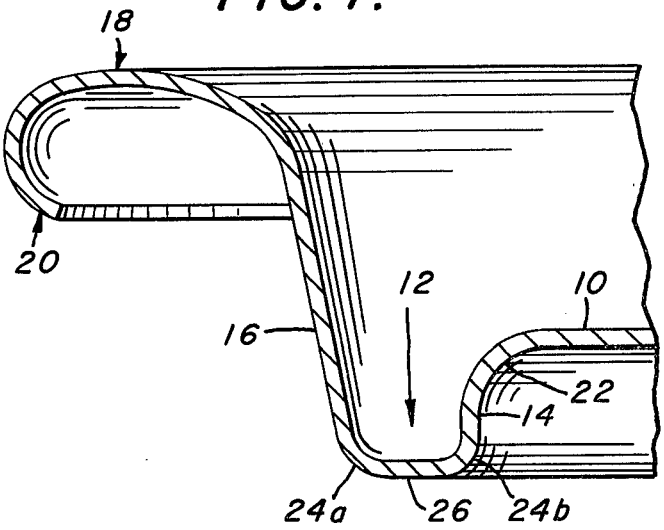
FIG. 7 is an enlarged fragmentary cross-sectional view of an alternative embodiment of a reformed can end of the present invention.

In another alternative mode of the subject invention, as shown in FIG. 7, the can end is reformed such that the curved portion 24 at the bottom of the annular groove 12 is flattened into a substantially planar bottom wall 26 between two curved portions **24*a* and 24*b*. In such mode, the radius of curvature at the first curved portion 22 is preferably increased from that of the initially formed can end and at least a portion of the inner wall 14 may be perpendicular to the plane of the center wall 10**.

Figure 8:
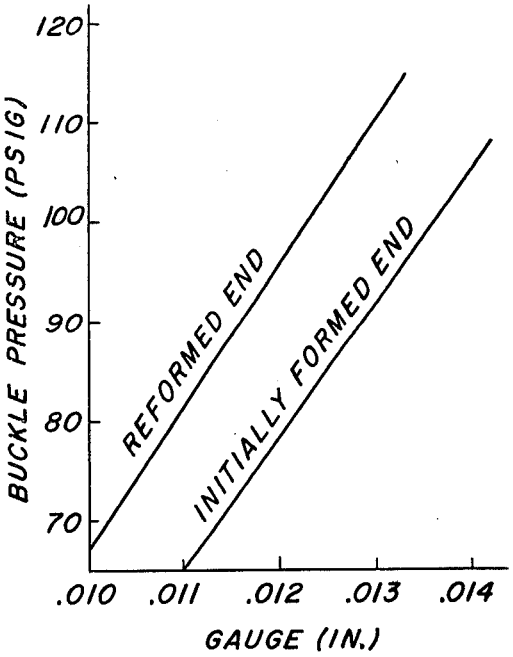
FIG. 8 is a graph comparing the pressure at which a conventional and a reformed can end will buckle at various gauges.

A sheet metal can end reformed by any of the above described methods is better able to withstand high internal pressures when applied to a cylindrical can body. Therefore, the gauge of the can end reformed by this method can be reduced or an alloy possessing a lower tensile strength may be utilized without loss in pressure holding capabilities with a corresponding savings in the cost of a can end. To illustrate the above, a conventional can end, such as that shown in FIG. 1, in light gauge sheet metal of 5182 aluminum alloy in coated, extra hard temper (H19) at 0.0127 inch gauge was applied to a can body and pressure tested. Such conventional can end buckled at an internal pressure of approximately 89 pounds per square inch. For comparison, a can end reformed in accordance with this invention (FIG. 6) in the same alloy, temper and gauge was also applied to a can body and pressure tested. The can end of this invention buckled at an internal pressure of approximately 105 pounds per square inch, or an improvement of about 18 percent in pressure holding capabilities. These results are illustrated graphically in FIG. 8. Improvements ranging as high as 19.3 percent have been experienced when testing 5182 aluminum alloy at 0.013 inch gauge.

It will be understood by those skilled in the art that the present invention may be practiced on a conversion press. The can end may be reformed in accordance with this invention simultaneously with any of the conversion operations, although it is preferred that the can end be reformed in the final conversion station.

Whereas the particular mode of this invention has been described above for purposes of illustration, it will be apparent to those skilled in the art that numerous variations of the details may be made without departing from the invention.

What is claimed is:

1. A method for reforming a metallic can end to increase the can end's buckle resistance, comprising the steps of:

providing a sheet metal can end having a substantially planar center wall, an annular groove around said center wall bounded on the inside by an integral inner wall and on the outside by an integral chuckwall, a first curved portion between said center wall and said inner wall, a second curved portion at the bottom of said annular groove between said inner wall and said chuckwall, a peripheral flange extending radially outwardly from said chuckwall for securement of said can end to a container, and exterior and interior surfaces with respect to the exterior and interior of a container when said can end is secured thereon;

supporting said center wall of said can end against the interior surface thereof; and reforming said can end by moving a drawing means into said groove and against the exterior surface of the second curved portion, while supporting the interior surface of the center wall to deepen said annular groove with respect to said center wall and reduce the radius of curvature of said second curved portion.

2. A method as set forth in claim 1 further comprising:

reorienting said inner wall between said first and second curved portions such that at least a portion of said inner wall is perpendicular to the plane of said center wall.

3. A method as set forth in claim 3 wherein the depth of the annular groove is increased from approximately 0.066 inch to approximately 0.090 inch, and the radius of curvature of said second curved portion is reduced from approximately 0.030 inch to approximately 0.020 inch.

4. A method as set forth in claim 3 wherein the can end is aluminum.

5. A method as set forth in claim 3 wherein the can end has a gauge in a range of 0.010 to 0.015 inch.

6. A method as set forth in claim 3 wherein the slope of the chuckwall is unchanged in the reforming operation.

7. A method for forming a buckle resistant metallic can end comprising the steps of:

providing a can end having a substantially planar center wall, an annular groove around said center wall bounded on the inside by an integral inner wall and on the outside by an integral chuckwall, a first curved portion between said center wall and said inner wall, a second curved portion at the bottom of said annular groove between said inner wall and said chuckwall, a peripheral flange extending radially outwardly from said chuckwall for securement of said can end to a container, and exterior and interior surfaces with respect to the exterior and interior of a container when said can end is secured thereon;

supporting said center wall of said can end against the interior surface thereof;

while supporting the center wall, reforming said can end by moving a drawing means into said groove and against the exterior surface of the second curved portion to increase the depth of said annular groove with respect to said center wall;

flattening the second curved portion into a substantially planar bottom wall between two curved portions; and reorienting said inner wall between said first and second curved portions such that said inner wall is substantially perpendicular to the plane of said center wall and the plane of said bottom wall.

8. A method as set forth in claim 5 wherein the can end is aluminum.

9. A method as set forth in claim 6 wherein the can end has a gauge in a range of 0.010 to 0.015 inch.

10. A method for reforming a metallic can end to increase the can end's buckle resistance, comprising the steps of:

providing a can end having a substantially planar center wall, an annular groove around said center wall bounded on the inside by an integral inner wall and on the outside by an integral chuckwall, a first curved portion between said center wall and said inner wall, a second curved portion at the bottom of said annular groove between said inner wall and said chuckwall, a peripheral flange extending radially outwardly from said chuckwall for securement of said can end to a container, and exterior and interior surfaces with respect to the exterior and interior of a container when said can end is secured thereon; and reforming said can end by moving a drawing means into said groove against the exterior surface of the can end at the bottom of said groove while simultaneously supporting the interior surface of the center wall to deepen said annular groove with respect to said center wall from approximately 0.066 inch to approximately 0.090 inch, increase the radius of curvature of said first curved portion from approximately 0.030 inch to approximately 0.050 inch, reduce the radius of curvature of said second curved portion from approximately 0.030 inch to approximately 0.020 inch, reorient said inner wall between said first and second curved portions such that at least a portion of said inner wall is perpendicular to the plane of said center wall, and decrease the height of the chuckwall as measured from the uppermost surface of the peripheral flange to the bottom of the annular groove.

* * * * *